US006368041B1

(12) United States Patent
Atwell et al.

(10) Patent No.: US 6,368,041 B1
(45) Date of Patent: Apr. 9, 2002

(54) DRUM ELEVATOR SYSTEM

(75) Inventors: Charles Gary Atwell, Mechanicsville, VA (US); Ricky N. Cooper, Concord, NC (US); Martin T. Garthaffner, Chesterfield, VA (US); Andrew J. Gillespie, Richmond, VA (US); Ronald D. Honaker, Powhatan, VA (US); William H. Pettigrew; William H. Smick, III, both of Richmond, VA (US)

(73) Assignee: Philip Morris Incorporated, Richmond, VA (US)

( * ) Notice: Subject to any disclaimer, the term of this patent is extended or adjusted under 35 U.S.C. 154(b) by 0 days.

(21) Appl. No.: 09/669,553

(22) Filed: Sep. 26, 2000

Related U.S. Application Data

(62) Division of application No. 09/154,775, filed on Sep. 17, 1998, now Pat. No. 6,123,201.

(51) Int. Cl.[7] ..... B65G 57/00

(52) U.S. Cl. ..... 414/295; 198/502.2; 131/282

(58) Field of Search ..... 414/293, 294, 414/295; 198/502.1, 502.2; 131/282

(56) References Cited

U.S. PATENT DOCUMENTS 3,885,683 A * 5/1975 Bornfleth et al. ..... 414/295 X
5,232,079 A 8/1993 Belcastro et al. ..... 209/535
5,301,011 A 4/1994 Hoppe et al. ..... 209/536
5,366,096 A 11/1994 Miller ..... 209/535
5,490,527 A 2/1996 Irikura et al. ..... 131/280
5,803,702 A * 9/1998 Mullins et al. ..... 414/788.7

FOREIGN PATENT DOCUMENTS

GB 1110268 4/1968 ..... 209/535

* cited by examiner

*Primary Examiner*—Tuan N. Nguyen
(74) *Attorney, Agent, or Firm*—Burns, Doane, Swecker & Mathis, LLP

(57) ABSTRACT

A drum elevator and method of elevating cigarettes, the apparatus including a series of rotatable cigarette transferring drums including a first plurality of horizontally disposed drums at a first elevation and a second plurality of vertically disposed drums extending to a second elevation, the second plurality of vertically disposed drums receiving output from the first plurality of drums, the series of drums adapted to receive a procession of cigarettes at the first elevation and to elevate the cigarettes along a transfer path to the second elevation while maintaining the cigarettes arranged substantially in the procession; a rejection station at a location along the transfer path; a controller operative to selectively actuate the rejection station; and a stack former at the second elevation, the stack former receiving output of the second plurality of vertically disposed drums.

2 Claims, 6 Drawing Sheets

DRUM ELEVATOR SYSTEM

This application is a div. of Ser. No. 09/154,775 Sep. 17, 1998 now U.S. Pat. No. 6,123,201.

FIELD OF INVENTION

The present invention relates to machines used in the manufacture of cigarettes, and more particularly to mass-flow elevators for transporting the output of cigarette makers to cigarette packing machines.

BACKGROUND OF INVENTION

In a typical filter tipping machine, two-up tobacco rods are transferred along a series of drums for the execution of manufacturing steps which ultimately create, near the exit of the tipping machine, a succession of individual, filter tipped cigarettes that are discharged from a final, exit drum. Usually a stack-former apparatus is placed adjacent the exit drum of the tipping machine to initiate the formation of a moving, multi-layered mass of cigarettes. The stacked mass of cigarettes is then directed through a mass-flow elevator to the accumulator and/or a tray filler, which interfaces with a cigarette packer. Downstream of the stack-former, tracking of individual cigarettes is usually not possible.

Mass flow elevators of the prior art commonly comprise a pair of mutually opposing, vertically oriented endless belts which vertically transport the stacked (multi-layered) mass of cigarettes to a height that is conducive to feeding cigarettes to the packer and/or an accumulator or tray filler. It has been found that when one of the belts fall, the elevator may still continue to vertically transport cigarettes, but in a manner that increases the risk of skewed cigarettes, product degradation (e.g., flatten "D" shaped cigarettes) and machine jams downstream of the elevator.

Tipping machines of the prior art have included one or more quality inspection stations at a location along the cigarette stream when the individual cigarettes have been fully formed and separated from one another. Typically, these devices inspect the cigarettes for loose ends, proper rod density, missing filters and other quality-indicative features. Because cigarettes are not fully constructed until close to the exit station of the tipping machine, there is but little room and opportunity for the placement and operation of the inspection devices and for effecting rejection of unacceptable cigarettes (i.e., cigarettes which have failed to pass one or more of the aforementioned quality inspection tests). There is also little or no room nor time for confirmation of a detector's initial reading.

Because cigarettes were heretofore mixed amongst each other soon after the exit of the tipping machine, all rejections of unacceptable cigarettes had been effected within the tipping machine, typically at a single rejection station at a fixed location along a single drum (usually the exit drum or a dedicated rejection drum just upstream of the exit drum). At the rejection station, a blast of compressed gas would be communicated to an underside of a passing flute known to carry an unacceptable cigarette by the flute tracking system of tipping machine controller. The blast is gauged to be sufficient to overcome the vacuum retention system of drum so as to blow the cigarette off the respective drum flute. Because the blast has to be complete and so immediate in so little space and time, the ejection process often rips or otherwise further damages the rejected cigarettes. The additional damage also tends to mask the true condition of the cigarette as it appeared at the inspection station, hampering resolution and correction of the casual problem at the cigarette maker.

Also, prior ejection systems heightened the risk of jams, because all ejections, for whatever reason out of a multiple of reasons, had to be undertaken at the exit station amongst a host of high speed, complicated rotating machinery. Additionally, if a consecutive series of cigarettes failed inspection, the repetitious operation of the rejection system would degrade its performance and/or tend to interfere with the vacuum retention system of the machine.

Heretofore, sampling of good cigarettes included the practice of a machine operator manually scooping a sample of cigarettes from the stacked mass. The scooping action has been found to occasionally skew cigarettes along the stack and to sometimes damage product.

OBJECTS AND SUMMARY OF THE INVENTION

Accordingly, an object of the present invention is to provide a cigarette elevator arrangement for transferring the output of a cigarette making module without the aforementioned problems of the prior art.

It is another object of the present invention to provide such a cigarette elevator, which has the additional capacity to reject cigarettes outside of the tipping machine so as promote a more efficient and reliable cigarette ejection system.

It is yet another object of the present invention to provide a cigarette elevator having the capacity to preserve order amongst a procession of cigarettes beyond a cigarette maker and/or its tipping machine so as to facilitate further and/or confirmatory inspection of the cigarettes.

It is another object of the present invention to provide a cigarette elevator module which facilitates additional inspection of the cigarettes without imposing significant changes to the layout of the cigarette manufacturing module.

It is yet another object of the present invention to provide a cigarette elevator such that repetitive rejection of cigarettes can be undertaken without disruption of acceptable cigarettes and with less risk of causing machine jams.

Still another object of the present invention is to provide an arrangement for confirmatory inspection of finished cigarettes such that false rejection of acceptable cigarettes is minimized.

Another object of the present invention is to provide a drum elevator having provision for gentle, damage-free sampling of cigarettes at the moment of their production.

Yet another object of the present invention is to gently transport the output of a cigarette maker to a cigarette packer and/or accumulator such that deformation of good cigarettes is minimized and the rejection of unacceptable cigarettes is as complete and accurate as possible.

These and other objects are achieved with the present invention which provides a drum elevator and method of elevating cigarettes, wherein the apparatus comprises a series of rotatable cigarette transferring drums that includes a first plurality of horizontally disposed drums at a first elevation and a second plurality of vertically disposed drums extending to a second, desired elevation. The second plurality of vertically disposed drums receive the output of the first plurality of drums, and the first and second pluralities of drums being adapted to receive a procession of cigarettes at the first elevation and to elevate the cigarettes to the second elevation while maintaining the cigarettes arranged in the procession. The drum elevator further comprises a rejection station at a location along the transfer path; a controller operative to selectively actuate the rejection station; and a stack former at the second elevation which receives the output of the second plurality of vertically disposed drums.

Another aspect of the present invention includes provision of a soft ejection station comprising a nip defined between a pair of adjacent cigarette conveying drums, with the upstream drum including a second vacuum plenum at the nip between the drums and an arrangement for selectively evacuating and venting the second plenum. Accordingly, the second vacuum plenum is arranged both to draw cigarettes onto the upstream drum upon evacuation and to gently release cigarettes from between the drums upon venting. Such action avoids damaging the sampled cigarettes during the ejection process so that they may be reclaimed, and it is not intrusive upon adjacent portions of the cigarette procession.

Yet another aspect of the present invention includes provision of a stack former comprising a counter arranged to generate a signal indicative of a rate of cigarettes entering the stack former, a substantially stationary element at a location along a pathway of the cigarettes such that cigarettes are discharged beyond the element as a stacked mass; and a conveyor controller configured to adjust an adjustable conveyor drive mechanism responsively to the signal indicative of cigarette rate so that the stacked mass of cigarettes is maintainable at a predetermined height.

BRIEF DESCRIPTION OF THE DRAWING

These and other objects and advantages novel features of the present invention will become apparent from the following detailed description of the preferred embodiments when considered in conjunction the drawing, wherein.

DETAILED DESCRIPTION

Figure 1:
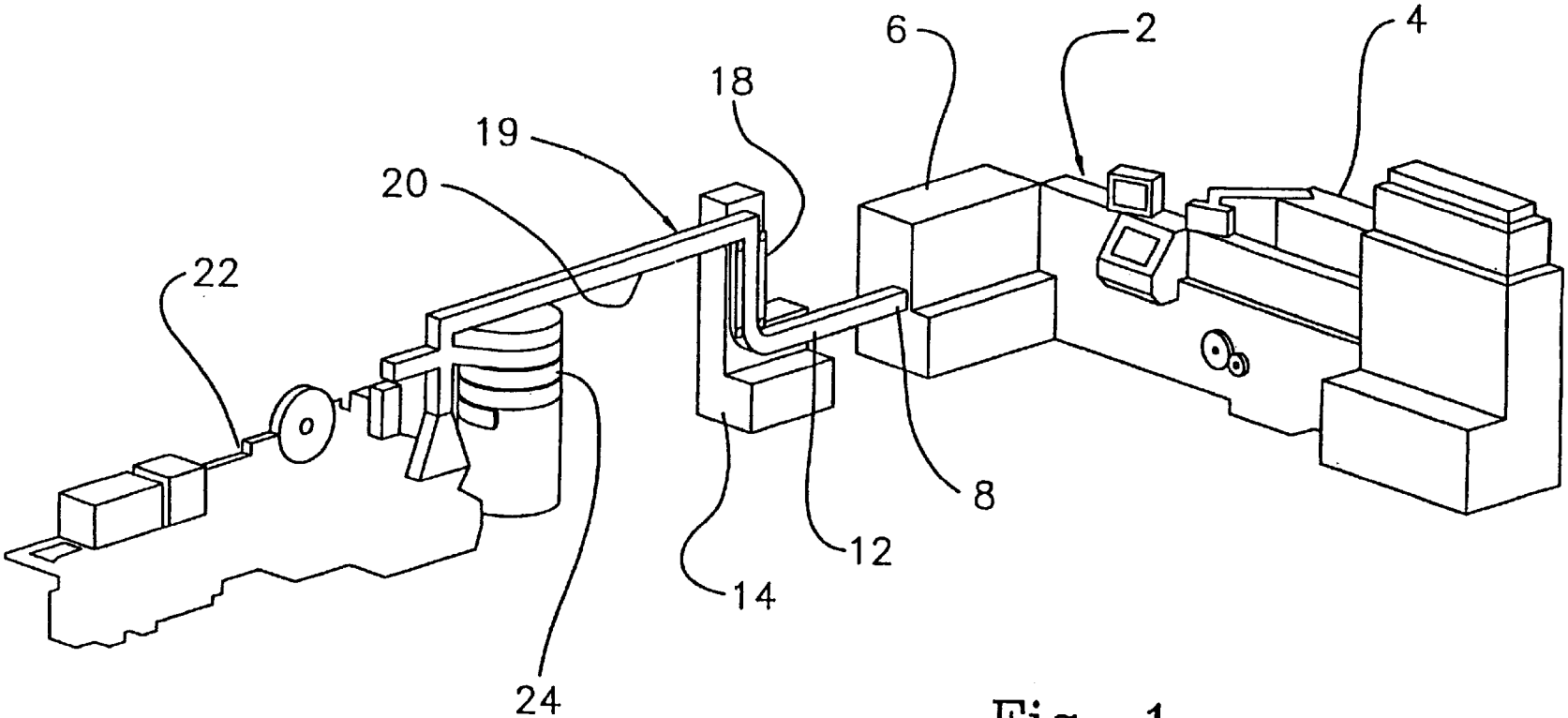
Fig. 1 (PRIOR ART)
FIG. 1 is a perspective view of a cigarette manufacturing system of the prior art.
Figure 2:
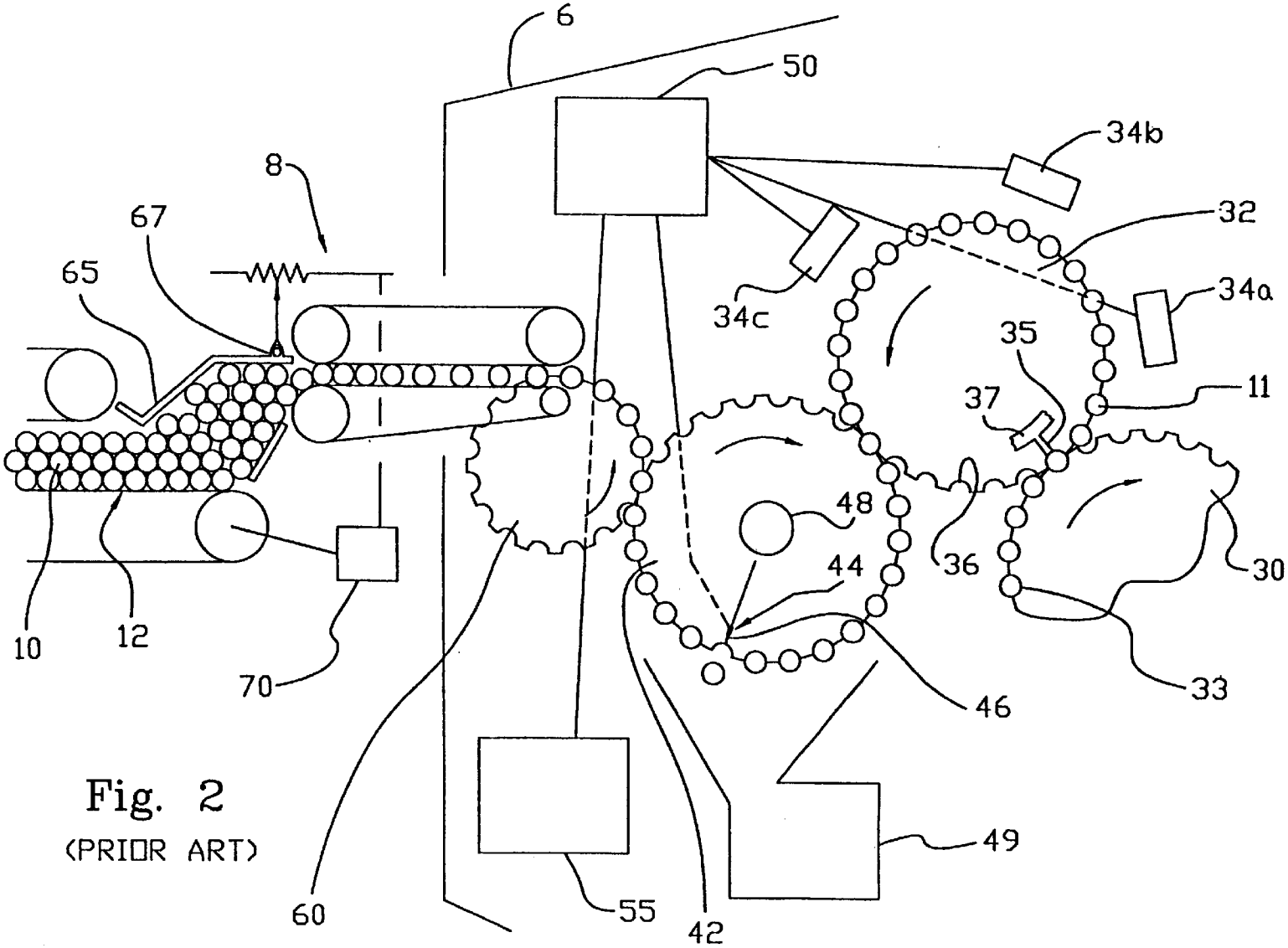
Fig. 2 (PRIOR ART)
FIG. 2 is a detailed cross-sectional diagram of exit station of a typical tipping machine of the prior art.

Referring now to FIG. 1 (prior art) a filter cigarette maker module 2 comprises a tobacco rod making machine 4 coupled with a tipping machine 6, the latter typically being arranged to interpose two-up filter plugs between spaced apart pairs of tobacco rods, securing same with tipping paper, and severing it to produce individual cigarettes. Referring now also to FIG. 2 (prior art), at the exit of the tipping machine 6 a stack former 8 is operative to transform the output of the tipping machine 6 into a mass of cigarettes 10 which are carried along a conveyor 12 to a mass flow elevator 14.

At the mass flow elevator 14 of the prior art, the stacked mass of cigarettes 10 are directed beneath a pair of opposing endless belts 16 and 18 which carry the stack of cigarettes 10 to a high elevation 19.

At the higher elevation 19, the stack of cigarettes 10 is typically directed along another conveyor 20 to a cigarette packing machine 22 and/or an accumulator 24. At the cigarette packer 22, the cigarettes are bundled and package into individual cigarette packs.

Referring to FIG. 2 (prior art), upstream of its exit, the cigarette tipping machine 6 typically includes a turning drum 30 having a plurality of vacuum actuated, cigarette retaining flutes 33. The turning drum 30 establishes a procession of individual cigarettes which are thereafter transferred onto an inspection drum 32 about which are situated one or more cigarette inspection stations 34*a,* 34*b* and 34*c*. Such is typical of the Max tipping machine manufactured by Hauni Machinenbauag of Hamburg, Germany.

By the time cigarettes 40 reach the inspection drum 32, the fabrication of the individual cigarettes 11 is complete. Conventionally, the finished cigarettes are transferred one after another onto the inspection drum 32. The inspection drum 32 itself has a plurality of circumferentially spaced, axially extending flutes 36 along its outer surface, each flute 36 having a longitudinal axis parallel to the rotational axis of the drum 32. Each flute 36 receives one cigarette 11 and the cigarette is held in the flute by reduced pressure ("vacuum") which is communicated to the flute by passageways 35 extending radially to the flute 36 from a vacuum plenum 37 disposed along the interior of the drum 32. Such vacuum is typically communicated only along the arcuate portion of the drum 32 along which the cigarettes are to be held as the drum 32 rotates to convey the cigarettes 11. When a cigarette ladened flute arrives at an angular location at which the cigarette 11 is to be transferred to the next, downstream drum (here, a rejection drum 42), vacuum to the flute of the upstream drum (here, drum 32) is interrupted at or preferably just upstream of the angular location of transfer so that the next downstream drum (here, the rejection drum 42) can pick up the cigarette 11 with little or no interference from the upstream drum (e.g., the inspection drum 32).

While the cigarettes are rotated about the inspection drum 32, they are inspected in the conventional way by inspection apparatus 34*a*–34*c* as is typically provided in the aforementioned Hauni Max machine. For example, its inspection station 34*a* may execute a "dilution check" to make sure that the cigarette has proper resistance to draw. The inspection station 34*b* may be arranged to execute an inspection of the tobacco rod density. Another station 34C might execute an inspection for missing filters. These inspections are mentioned only for purposes of example, and others might be undertaken either in substitution for or in addition to the ones specifically mentioned here.

Typically, any output signal from the inspection stations 34*a*–34*c* indicating the presence of an unacceptable cigarette on one of the flutes 36 of the drum 32 is communicated to the controller 50, which also receives signals from the drum drive train 55 of the tipping machine 6. With such input, the controller 50 tracks the whereabouts of unacceptable cigarettes as they transfer from the inspection drum 32 to the rejection drum 42.

As the procession of cigarettes 11 are rotated about the rejection drum 42, they pass beneath a rejection station 44 whose operation is subject to the tracking and control of the controller 50. The rejection station 44 typically comprises one or more valved, air jets 46 that are communicated with a source of pressurized air 48. Because of the limited confines within the tipping machine, the Max tipping machine will typically have only one of such rejection stations 44 such that all unacceptable cigarettes are discharged at this singular station and collected together in a bin 49 located adjacent the rejection drum 42.

Also, because of the extreme machine speeds of the tipping machine and because the output of the rejection jet 46 must overcome the retention action of the drum vacuum system, the discharge from the jet 46 must be immediate and forceful so as to assure complete removal as the unacceptable cigarette arrives at the rejection station 44.

Typically, those cigarettes 11 which pass inspection (i.e., acceptable cigarettes) are transferred from the rejection drum 42 onto the exit drum 60; then through a stack former 8 located adjacent the exit of the tipping machine 6; and onto the conveyor 12 whose speed is controlled by a controlled drive mechanism 70. The stack former 8 includes a rotatable deflector plate 65 which is angularly deflected about a pivot 67 by the stream of cigarettes coming off the exit drum 60. Deflection of the plate 65 adjusts a rheostat, which in turn causes the controller 70 to adjust the speed of the conveyor 12 and thereby adjust the height of the stack 10. If a great number of cigarettes are discharged against the deflector plate 65, it is upwardly displaced, which motion causes a signal to the controller 70 to increase the speed of the conveyor 12 so that the stack of cigarettes 10 remains at a desired height. If fewer cigarettes arrive at the stack former 8, the deflector plate 65 drops, sending a signal which causes the controller 70 of the conveyor 12 to slow the conveyor speed to maintain the height of the stack 10.

In the above-described system of the prior art, all unacceptable cigarettes are rejected together and commingled, in a manner with oftentimes leads to damage of the rejectable cigarette, all which factors frustrate statistical analysis of types and reasons for cigarettes to fail inspection. The system also loses tracking of unacceptable cigarettes at the stack former where all cigarettes are bunched together as a massed stack of cigarettes 10.

Also, if a repetitive stream of unacceptable cigarettes pass through the system, the rejection station 44 must operate repetitively at high machine speeds such that operation of the jets 46 may disrupt proper operation of the vacuum retention system on the rejection drum 42 such that good cigarettes are unintentionally rejected and, worse still, cigarettes become jammed at or about the inspection drum 42 and/or the exit drum 60.

Figure 3:
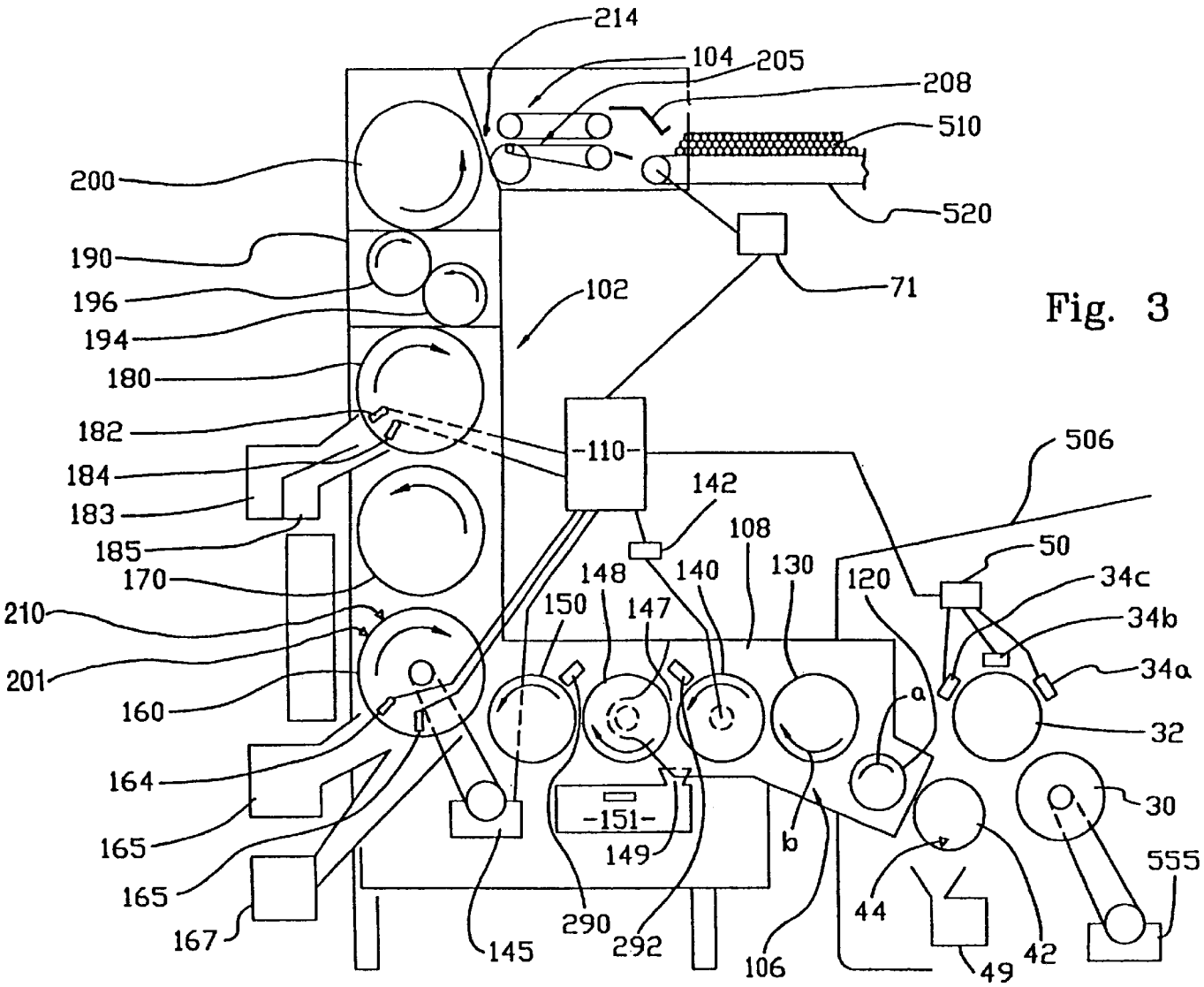
FIG. 3 is a drum elevator system constructed in accordance with a preferred embodiment of the present invention, together with adjacent details of a tipping machine that has been modified to cooperate therewith.

Referring now to FIG. 3, a preferred embodiment of the present invention provides a drum elevator system 100 for an improved and orderly handling of the output of a tipping machine 506 for delivery to an elevated conveyor 520 (or other system for delivering cigarettes to an automated cigarette packer). The elevator system 100 preferably comprises a vertical series of drums 102 at the top of which a stack former 104 operates to form a stack 510 of cigarettes at a location which is adjacent the conveyor 520 and distal of the exit of the tipping machine 506. A horizontal series of drums 106 operatively link the vertical series of drums 103 with the exit of the tipping machine 506 and includes a link-up gear box assembly 108 such that at least the first several of the horizontal drums 106 are driven by the tipping machine 506.

In the preferred embodiment the horizontal series of drums 106 preferably comprise the first five drums (120, 130,140,148,150) and the vertical series of drums 102 preferably comprise the next three drums (160, 170,180) together with the drums immediately preceding the stack former 104 (drums 194,196,200). It is contemplated that one of ordinary skill upon a reading and understanding of this entire disclosure might employ greater or lesser numbers of drums amongst the vertical and horizontal series of drums 102, 106 in the practice of the present invention.

Preferably, the link-up gear box 108 includes the first three drums (120, 130,140) of the drum elevator system 100. Preferably, each drum of the drum elevator system 100 is provided about its periphery a plurality of axially directed, circumferentially spaced-apart flutes which receive and releasably retain individual cigarettes under the action of a vacuum retention system as previously explained for drums such as found on the tipping machine 6 and 506. Other similarly functioning mechanisms might be employed to effect a releasable retention of cigarettes 11 on the drums of the drum elevator system 100.

Referring to FIG. 3, the transfer and retention of cigarettes from drum to drum along the drum elevator system 100 is represented by arcuate arrows at each drum (such as arrows a and b at the first and second drums 120 and 130, respectively) which indicate generally the preferred angular location along each drum where cigarettes are received by a drum and the preferred angular location where cigarettes are released from the respective drum and transferred to the next. For example, in the link-up gear box 108, the first drum of 120 receives cigarettes from the rejection drum 42' of the tipping machine 506 at approximately at a 4 o'clock position and transports it approximately 1800 in a counter-clockwise direction to a 10 o'clock position where the cigarettes are transferred to the second drum 130 of the link-up gear box 108. In turn, the second drum 130 delivers cigarettes to the third drum 140 of the link-up gear box 108.

The first drum 120 of the link-up gear box 108 is preferably a replica of the original or standard exit drum 60 of the tipping machine 506 (and tipping machine 6' from which the former is adapted), except that the first drum 120 is rotatably mounted to the link-up gear box 108 and is drivingly linked with the second and third drums 130, 140 of the link-up gear box 108 by belts and/or drive chains, such that rotation of the first drum 120 causes synchronous rotation of the second and third drums 130, 140. The first drum 120 is also connected with the portion of drive train 555 of the tipping machine 506 that is otherwise available to drive the exit drum 60 of the tipping machine. Accordingly, as the drive train 555 of the tipping machine 506 causes the drums 30' and 42' to rotate under the command of the controller 50' of the tipping machine 506, the first drum 120 of the gear box link 108 is also caused to rotate, together with the second and third drums 130, 140. By such arrangement, the first three drums (120,130 and 140) of the elevator 100 are caused to rotate synchronously with the drums within the tipping machine 506 as commanded by the controller 50' of the tipping machine 506.

Preferably, drums beginning with the fourth drum 148 and all upstream drums thereafter (drums 150,160,170,180,194, 196,200) are linked together by gearing or more preferably, a system of belts to rotate synchronously together. In the preferred embodiment, only the sixth drum 160 of that group is driven by the drive mechanism 145 of the elevator system 100, although another drum or drums of the group might be selected.

The drum elevator system includes its own controller 110 for executing operator commands and maintaining desired drum speeds of the fourth drum 148 and all upstream drums thereafter (drums 150,160,170, 180,194,196,200). Preferably, a shaft-speed encoder 142 is operatively located at the third drum 140. The shaft encoder 142 provides a signal to the controller 110 indicative of the rotational speed of the third drum 140 of the link-up gear box 108. For production operation, the controller 110 is configured to control, responsively to the signal generated from the shaft-speed encoder 142, the speed at which the drive mechanism 145 drives the sixth drum 160, so that the sixth drum 160, together with all the other drums linked with it, are synchronized with the rotation of the third drum 140. At other times, such as when the machine operator enters a command at the controller 50' to stop operations (shut-down), the controller 110 is preferably configured to continue rotation of the remainder of drums of the elevator system 100 independent of the first, second and third drums (120, 130,140) for a time sufficient to clear product from the elevator system 100.

Although the preferred embodiment utilizes a reading of drum speed of the third drum 140, another drum of the link-up gear box 108 could be used instead.

Between the third drum 140 and the fourth drum 148 is established a "soft" ejection station 146 which is operable at the command of the controller 110 to interrupt transfer of cigarettes between the third and fourth drums (drums 140, 148) so as to gently remove cigarettes from the stream of cigarettes and to direct them instead through chute a 148 to a sampling draw or bin 149 for collection and inspection.

Figure 4:
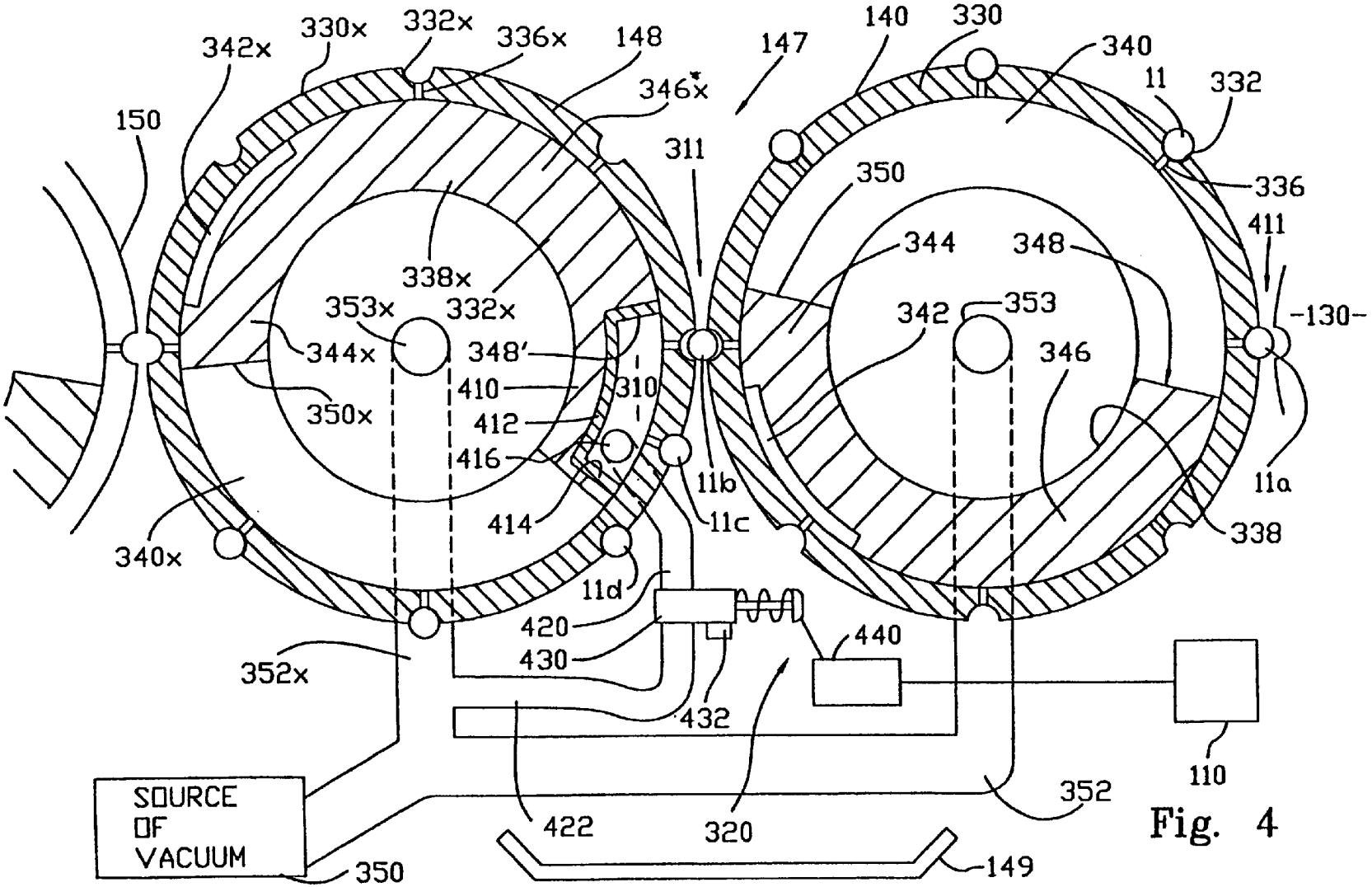
FIG. 4 is a cross-sectional side view of a soft ejection station included within the drum elevator system of FIG. 3.

Referring now to FIG. 4, the soft ejection station 147 preferably comprises modifications to the fourth drum 148 such that it includes a second vacuum plenum 310 adjacent the nip 311 established between the third and fourth drums (drums 140, 148) and a plenum control system 320 which is operable to selectively communicate a vacuum or alternatively a vent to the second vacuum plenum 310 responsively to signals preferably from the controller 110 of the drum elevator system 100.

The third drum 140 preferably comprises a rotatable outer drum portion 330 having a plurality of spaced-apart flutes 332 that are sized to receive a cigarette 11. Each flute is communicated with the interior of the drum 140 through one or more, preferably at least two, vacuum ports 336. The outer drum portion 330 rotates about a fixed inner drum body 338 which includes air control flanges that establish, in cooperation with the outer drum portion 330, a vacuum plenum 340, a vacuum relief plenum 342 and first and second vacuum closure portions 344 and 346. The vacuum plenum 340 extends circumferentially about the drum interior from a first angular position 348 just upstream of the nip 411 between the second and third drums 130,140 to a second angular position 350 just upstream of the nip 311 between the third and fourth drums 140,148. The vacuum plenum 340 is communicated with a vacuum source 350 through a vacuum duct 352.

By such arrangement, the vacuum plenum 340 is operative to pick up a cigarette 11*a* from the preceding second drum 120 and to retain the cigarette 11*a* upon the respective flute 332*a* as the outer drum portion 330 rotates toward the second angular position 350. Thereat, the first vacuum closure portion 344 of the fixed drum body 338 obstructs communication of vacuum to the vacuum ports 336 of the flute so as to facilitate transfer of the cigarette 11 to the next (fourth) drum 148. The vacuum release plenum 342 is provide just downstream of the nip between the third and fourth drums 140,148 which serves to vent the vacuum ports 336 to the surrounding environment at an angular location just downstream of the nip 311 to minimize any tendency for a cigarette 11 to remain drawn to the flute 332 of the third drum 140. The second vacuum closure portion 346 maintains closure of vacuum ports 336 until a respective flute 332 arrives again at the first angular location 348.

Preferably, all of the other drums of the drum elevator system 100, except fourth drum 148, are constructed like the arrangement of the third drum 140 with a vacuum plenum is provided along the angular path extending from just upstream of where the drum first receives a cigarette to just upstream of where the drum is to release a cigarette to a subsequent drum.

As previously mentioned, establishment of soft ejection station 147 includes modifications of the fourth drum 148 to include an independently operable, second vacuum plenum 310.

In particular, the fourth drum 148 includes a fixed drum body 338*x* and a rotatable drum portion 330*x* like those of the third drum 140, except that the fixed drum body 338*x* is extended to include a third body portion 410 which receives a fixture 412 that encloses the second vacuum plenum 310. Preferably, the second plenum originates at an angular position slightly upstream of the nip 311 between the fourth and third drums 148,140 as viewed in the direction of movement of the rotatable drum portion 330*x* of the fourth drum 148. Preferably, the second plenum 310 initiates approximately 50 to 100 upstream of the nip 311, more preferably approximately 70, and extends approximately 300 to 500 beyond the nip 311, more preferably approximately 420. At the terminus 414 of the second vacuum plenum 310, the fixture 412 and/or the third portion 410 of the fixed drum body 338*x* provide a seal with the rotatable drum portion 330*x* so as to isolate the second vacuum plenum 310 from the first vacuum plenum 340*x*. The first vacuum plenum 340*x* is constructed like the vacuum plenum 340 of the third drum 140, except that it accommodates a clockwise drum rotation instead of a counter-clockwise one and is angularly shorter because of its partial displacement by the second vacuum plenum 310. A vacuum line 352*x* communicates the first vacuum plenum 340*x* with a source of vacuum 350 though a port 353*x* as is arranged in the third drum plenum 340.

Preferably, the plenum fixture 412 is provided with a vacuum port 416, which is connected to a valve 430 of the plenum controller system 320 through a first conduit 418. The valve 430 preferably includes a vent port 432 and is also connected to a vacuum line 422, which leads to the source of vacuum 350, either directly or more preferably through a connection with the vacuum line 352*x*.

Preferably, the second plenum has an arc distance approximating the distance of two flutes lengths along the fourth drum 148. Accordingly, upon venting of the second plenum 310, a cigarette 11*b* at or about the nip 311 and another cigarette 11*c* mid-way across the arc distance of the second plenum 310 will be released. A third cigarette 11*d* at or near the end of the arc distance of the second plenum 310 is retained upon the fourth drum 148, because of the residual vacuum retention at that flute.

Preferably, the first and second plenums 310,340*x*,340 are provided at minimum with 65 millibars of underpressure, preferably 100 to 110. With such, the drum elevator system 100 is capable of sending a lone cigarette 11, with all other flutes empty, along the entire length of the drum elevator at a rate of 8,000 cigarettes per minute.

Figure 5:
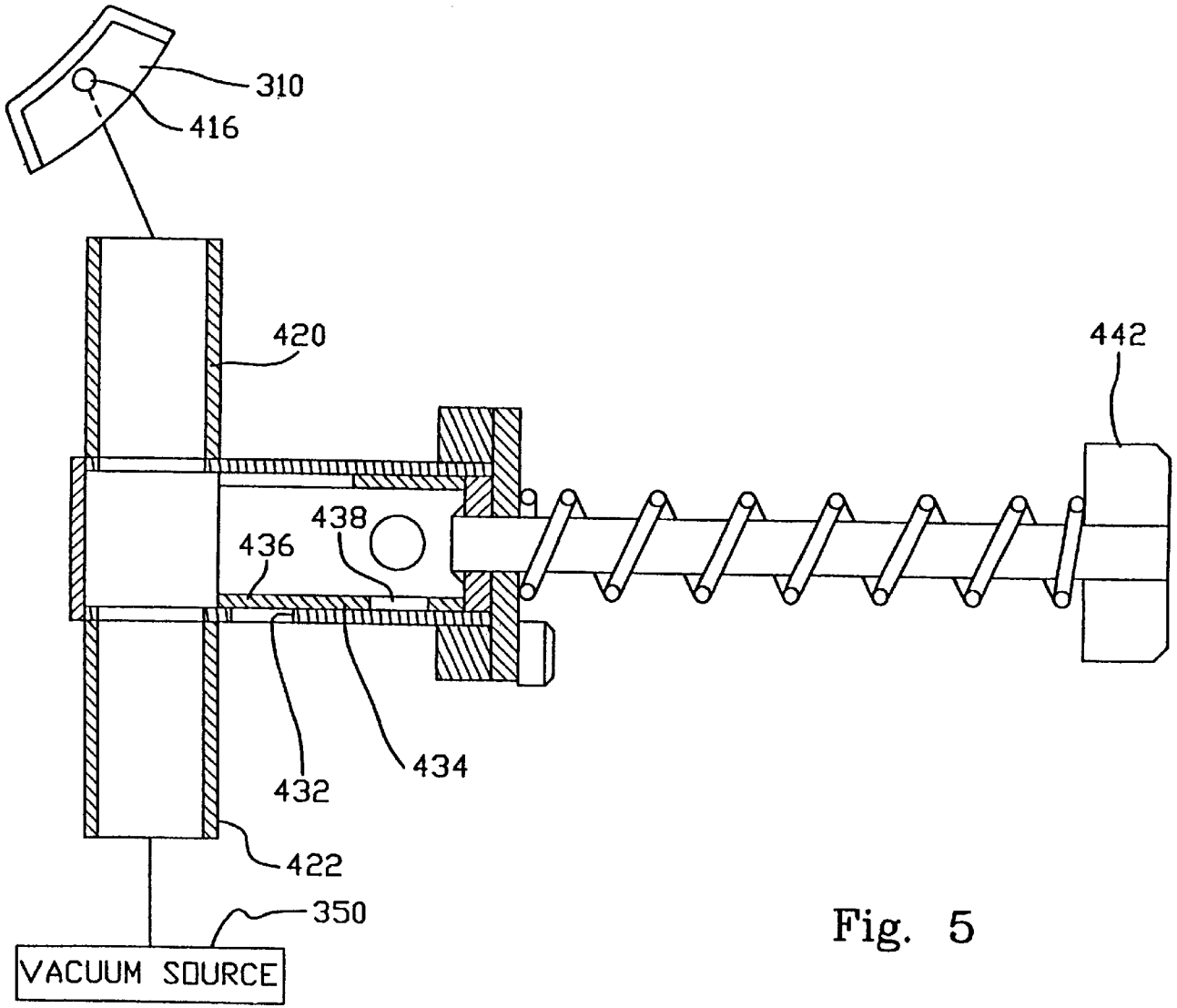
FIG. 5 is a cross-sectional side view of a valve of the soft ejection station shown in FIG. 4.

Referring now also to FIG. 5, the valve 430 preferably includes a valve body or slider 434 that is movable from a retracted position (as shown in FIG. 5) and a venting position. While in the retracted position, the valve 430 permits communication between the conduit 420 and the vacuum line 422 so that the vacuum source 350 may draw a vacuum from the second vacuum plenum 310. At the venting position, the vacuum line 422 is closed by a valve flange 436, and the conduit 420 is communicated with the vent 434 through an orifice 438 in the valve body 434 so that any vacuum in the second plenum is relieved. Accordingly, a vacuum cannot be reestablished in the second plenum 310 until communication between the second plenum and the vacuum source 350 is reestablished upon return of the valve body 434 to its retracted position.

Preferably, the valve 430 is actuated through a hydraulic or electrical actuator 440 that is operable from receipt of signals from the controller 110 of the drum elevator system 100. In the alternative, the valve actuator 440 may comprise a manually operable, spring loaded plunger 442. With all actuators, it is preferred that the actuator biases the valve body 434 toward its retracted position.

In operation, as acceptable cigarettes 11 are carried about the third drum 140 into the nip between the third and fourth drums 140,148, the controller 110 keeps the valve 430 at its retracted position so that a vacuum is established in the second vacuum plenum 310. As acceptable cigarettes 11 are carried by the third drum 140 into the nip between the third and fourth drums 140,148, the vacuum retention action of the third drum 140 is interrupted just upstream of the nip while simultaneously vacuum of the second plenum 310 is communicated to an adjacent flute 332*x* of the fourth drum 148 as it too enters the nip. As a result, the cigarette 11 (such as the cigarette 11*b* in FIG. 4) is drawn toward the adjacent flute 332*x* of the fourth drum 148 and is retained upon the fourth drum 148 by the vacuum retention action of the second and first vacuum plenums 310,340*x*, whereupon it is released to the fifth drum 150.

If the cigarette 11*b* is unacceptable acceptable (e.g., one of the inspection stations 34*a*–34*c* of the Max tipping machine 506 had indicated that the cigarette 11*b* is unacceptable), or if a signal is received from the controller 110 that a sampling of cigarettes is to be undertaken, the controller 110 will cause the valve 340 to vent the second vacuum plenum 310 so as to prevent the transfer of the cigarette 11*b* from the third drum 140 to the fourth drum 148 and to allow instead for the cigarette to fall from between the drums 148,140 into the chute 149 leading to a collection the bin (drawer) 151. This soft ejection action may be continued for given number of additional cigarettes and/or for a predetermined amount of time as established by the controller 110 when using the soft ejection station 147 for sampling. Thereafter, or alternatively, after the single rejection of the cigarette 11*b*, the valve 430 is preferably returned to its retracted position to thereby reestablish a vacuum in the second plenum 310.

It is to be realized that the soft ejection station 147 effects removal of cigarettes without imposing a potentially damaging blast of pressurized air or the like upon the cigarette. Accordingly, a set of sampled, yet acceptable cigarettes can be returned to the stream of cigarettes being fed into the packing machine; and if the sampled cigarettes are unacceptable, their true condition is not masked by any further damage from the sampling process.

Alternatively, the soft rejection station 147 may be constructed utilizing the principles and arrangements taught in U.S. Pat. No. 5,232,079. Optionally, a rail may be imposed at an angular position along the third drum 140 downstream of nip 311 so as to assure removal of any clinging, untransferred cigarettes from the third drum 140.

Referring back to FIG. 3, at the sixth drum 160, the procession of cigarettes is preferably carried 2700 about the drum to enter the remainder of the vertical series of drums 102 of the drum system 100. Preferably, rejection ports are 164, 166 are provided at approximately the 6 o'clock and 8 o'clock angular positions, respectively, about the drum 160. These rejection ports 164, 166 preferably comprise a type like those employed at the rejection drum 92' of the tipping machine 506. These rejection ports 164, 166 are adapted to pneumatically discharge unacceptable cigarettes from the sixth drum 160 upon command from the controller 110 so as to discharge cigarettes into the bins 165, 167, respectively.

Cigarettes are then transferred about the next seventh drum 170 wherefrom they are transferred to an eighth drum 180 of the vertical series of drum 102. Preferably, the eighth drum 180 includes rejection ports 182, 184 at its 8:00 o'clock and 7:00 positions, which are adapted to discharge cigarettes at the command of the controller 110 into bins 183 and 185, respectively.

The procession of cigarettes at the eighth drum 180 are transferred to the convertible drum assembly 190, which in this preferred embodiment comprises a ninth and tenth drums, 194, 196. These ninth and tenth drums deliver cigarettes to the eleventh drum 200 such that cigarettes are delivered to the stack former 104 in the desired direction which, in this embodiment, is toward the right as viewed in FIG. 3 so that cigarettes throughout their travel from the first drum 120 to the eleventh drum 200 have traveled a C-shaped path.

Figure 6:
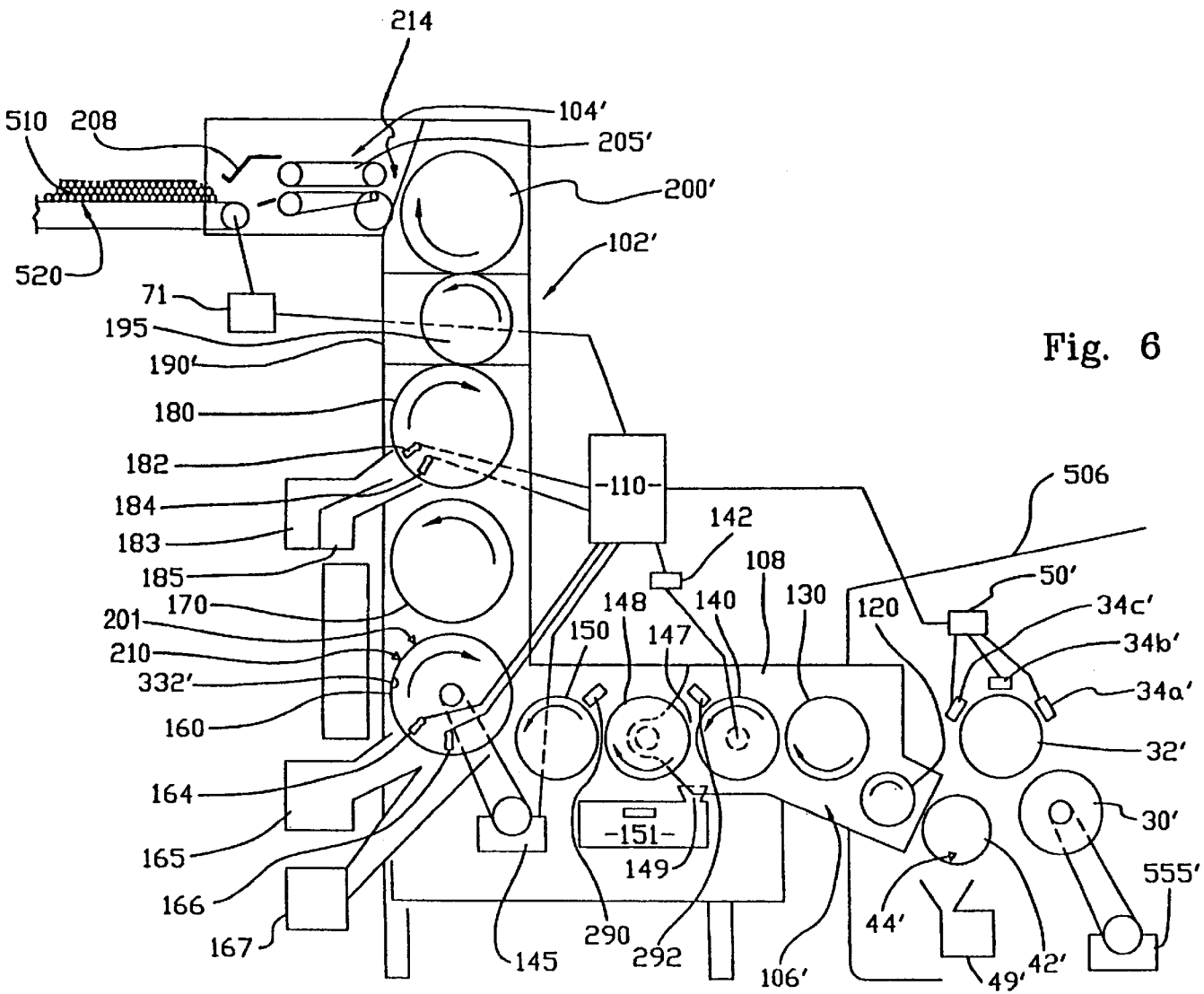
FIG. 6 is a diagram of an alternate, preferred embodiment of the present invention.

Referring now to FIG. 6, in an alternate embodiment, the convertible drum assembly 190' comprises a single drum 195 instead of the pair of drums 194 and 196 of the previous embodiment. The stack former 104' and the eleventh drum 200' are essentially the same systems as in the prior embodiment, but turned around so as to discharge cigarettes to the left as viewed in FIGS. 3 and 6. Accordingly, the vertical set of drums 102' and the horizontal set of drums 106' of the alternate embodiment define a Z-shaped pathway for the cigarettes.

Referring back to FIG. 3, as cigarettes 11 are transferred from the eleventh drum 200 into the stack former 104, they are directed through a single row stacker 205 before accumulating into a cigarette stack 510 in cooperation with the fixed, deflection plate 208. The stack 510 is moved toward a cigarette packing machine and/or accumulating system situated at a downstream location along the conveyor 520 whose speed is controlled by a controlled drive mechanism 71 that is controllably linked to the controller 110 of the drum elevator system 110. As an optional part of the drum elevator system 100, an improved stack former 104 includes a fixed deflector plate 208 and a modified drive and controller arrangement for the conveyor 520 wherein the motor speed of the conveyor 520 is determined from at least one of the outputs of photo-cell counters 210 and 212 preferably located at the sixth drum 160 and a photo-cell counter 214 preferably located adjacent the fixed deflector plate 208.

Preferably, the first photo cell 200 at the drum 160 is configured to count all flutes 332' of the sixth drum 160 as they pass by the photo sensor 200 so as to establish a 100% baseline signal. The second photo cell 210 at the sixth drum 160 counts the number of cigarettes 11 actually passing the photo cell 210. The third photo cell 214 at the deflector plate 208 counts the actual number of cigarettes 11 entering the stack former 204. From these signals, the actual cigarette count and the drum elevator speed are established and used for controlling the speed of the conveyor 520 such that conveyor speed and stack height are controlled with digital precision and minimum intermittent lunches.

With the drum elevator system as described, damaged-free sampling of cigarettes may be undertaken using the soft ejection port 146 as previously described.

Additionally, should the tipping machine 506 shut down, the controller 110 may be configured to continue the drive mechanism 145 for a predetermined period of time to clear those cigarettes which have transferred upon the fourth drum 148 and those situated beyond.

Furthermore, one or more rejection ports of a given drum, such as those at the sixth drum 160, can be dedicated to the removal of cigarettes having a predetermined type of unacceptability. For instance, the inspection station 34*b* might be arranged to detect missing filters. In such case, interaction between the controller 50' of the tipping machine and controller 110 of the drum elevator system 100 might be arranged such that the rejection port 164 of the sixth drum will undertake removal of those cigarettes found to be unacceptable for missing filters by the inspection station 34*b*. Accordingly, those rejections would be undertaken only at the sixth drum of the elevator 100 instead of at the rejection drum 142' of the tipping machine. The other rejection stations, such as the other rejection port 166 of the sixth drum 160 and those of the eighth drum 180 might be dedicated to other forms of unacceptability. Such arrangements provide an opportunity to separate unacceptable cigarettes according to type of imperfection amongst the several bins (e.g., 183, 185 adjacent the eighth drum 180 and the bins 165 and 166 of the sixth drum 160).

Additionally, or in the alternative, if repetitive rejections need to be undertaken for a long procession of the unacceptable cigarettes, the controller 50' of the tipping machine 506 and the controller 110 of the drum elevator system 100 may be configured to have the consecutive rejections undertaken at one or more of the drums such as those at drums 160 and/or 180 to alternate the execution of rejections amongst the rejection ports. Accordingly, the situation of having a single rejection port execute a long series consecutive rejection operations is avoided and the risk of depleting the vacuum retention system of any given drum is avoided.

Additionally, the drum elevator system 100 provides space for placement of additional inspection stations, such as detectors 290,292 at the fifth and third drums 150,140, respectively, that may be dedicated to execute confirmatory inspections of cigarettes 11 such that in order for a cigarette to be subjected to a rejection, it must fail an initial inspection, for instance at the inspection station 34*a'* with within the tipping machine 506, and fail the same type of test as conducted at another inspection station along the drum elevator 100, for instance at the inspection station 292 adjacent the third drum 140. By such arrangement, false rejection of good product is minimized and production efficiency is enhanced.

It is to be understood that present invention may be embodied and other specific forms doubt departing from the spirit or essential characteristics of the present invention. For example, interaction between the controllers, the inspection stations and the rejection stations amongst the various drums might be configured differently from that explained in connection with the deferred embodiment. The number and size of drum might be altered to meet certain space requirements at a manufacturing facility. Additionally, the preferred embodiment is described with reference to a cigarette maker module that is configured to produce filter cigarettes. The invention is readily adaptable for use in conjunction with a cigarette maker module that is configured to produce non-filter cigarettes. The scope of the invention is indicated by the dependent claims rather than by the foregoing descriptions and all the changes and variations which fall within the meaning and range of the claims are intended to be embrace therein.

What is claimed is:

1. A stack forming comprising:

a counter arranged to generate a signal indicative of a rate of cigarettes entering said stack former;

a substantially stationary element at a location along a pathway of said cigarettes such that cigarettes are discharged beyond the element as a stacked mass; and a conveyor controller configured to adjust said adjustable conveyor drive mechanism responsively to said signal of cigarette rate so that said stacked mass of cigarettes is maintainable at a predetermined height.

2. A stack forming system comprising:

a conveyor;

adjustable means for driving said conveyor selectively amongst a range of conveyor speeds;

a stack former comprising:

a counter arranged to generate a signal indicative of a rate of cigarettes entering said stack former;

a substantially stationary element at a location along a pathway of said cigarettes such that cigarettes are discharged beyond the element as a stacked mass of cigarettes upon said conveyor; and a conveyor controller configured to adjust said adjustable conveyor drive means responsively to said signal of cigarette rate so that said stacked mass of cigarettes is maintainable at a predetermined height.

* * * * *